US005103077A

United States Patent [19]

Goessler et al.

[11] Patent Number: 5,103,077

[45] Date of Patent: Apr. 7, 1992

[54] INDICATOR FOR COOKING APPLIANCES

[75] Inventors: Gerhard Goessler, Oberderdingen; Eugen Wilde, Knittlingen, both of Fed. Rep. of Germany

[73] Assignee: E.G.O. Elektro-Gerate Blanc u. Fischer, Fed. Rep. of Germany

[21] Appl. No.: 654,947

[22] Filed: Feb. 13, 1991

[30] Foreign Application Priority Data

Feb. 13, 1990 [DE] Fed. Rep. of Germany ..... 4004309

[51] Int. Cl.[5] ..... H05B 3/74

[52] U.S. Cl. ..... 219/453; 219/506; 219/464

[58] Field of Search ..... 219/453, 506, 443, 458, 219/459, 460, 461, 464, 465

[56] References Cited

U.S. PATENT DOCUMENTS

| | | | |
|---|---|---|---|
| 2,492,100 | 12/1949 | Kitson | 219/453 |
| 4,794,233 | 12/1988 | Goessler | 219/464 |
| 4,990,750 | 2/1991 | Martel | 219/453 |
| 5,013,893 | 5/1991 | Goessler | 219/453 |

FOREIGN PATENT DOCUMENTS

| | | |
|---|---|---|
| 1949906 | 9/1964 | Fed. Rep. of Germany . |
| 3501365 | 7/1986 | Fed. Rep. of Germany . |
| 3635345 | 4/1988 | Fed. Rep. of Germany . |
| 3812490 | 11/1989 | Fed. Rep. of Germany . |
| 3831233 | 3/1990 | Fed. Rep. of Germany . |
| 1346574 | 2/1974 | United Kingdom . |

*Primary Examiner*—Teresa J. Walberg

*Attorney, Agent, or Firm*—Eckert Seamans Cherin & Mellott

[57] ABSTRACT

In a cooker with an at least partly translucent cooking or hob surface an operating or hot indication takes place through modular units surrounding the heating unit and which contain individual glow lamps and are spaced from one another around the circumference of the heating unit. They are fixed by holders to the outer rim of the heating unit and are electrically interconnected.

Through a different wiring of the individual glow lamps or units it is possible to indicate different states of the heating unit.

17 Claims, 2 Drawing Sheets

INDICATOR FOR COOKING APPLIANCES

BACKGROUND OF THE INVENTION

The invention relates to an indicator for cooking appliances with at least one partly transparent or translucent, upper surface. The term "cooking appliances" includes hotplates for cooking, heating and baking purposes. The upper surface can itself be a cooking surface, such as e.g. in the case of a glass ceramic plate, but can also be a mounting plate, e.g. of hard glass, in which the hotplates are mounted. It has already been proposed (U.S. patent application Ser. No. 407,205 filed on Sept. 14, 1989 by Gerhard GOESSLER and Ortwin SCHAN (allowed)), to surround the heating unit of a cooking appliance with illuminating or lighting means, namely a light guide, which has several light outputs on its circumference. It is able to indicate different states on the cooking appliance.

It is also known to place a signal lamp on the outer circumference of a heating unit (DE-A-35 01 365). It is also known to illuminate the area around a heating unit by a central lamp with a low reflector (GB-B-1 346 574).

German utility model 19 49 906 describes a cooking appliance having a top surface with different windows around several cooking plates, which window can be illuminated by different lamps if the cooking plate is switched on.

These devices suffer from the disadvantage that they are in part too complicated, have an excessive overall height or do not have an adequate indicating function. It is in fact desired to bring the indication or display into a form corresponding to what naturally happens in the case of a heated cooking utensil, i.e. for illumination to occur where it is warm or hot, whilst the indication or display is readily visible.

SUMMARY OF THE INVENTION

The invention makes it possible to provide a striking, easily manufacturable and fittable indicator without increasing the overall height.

The row of individual, individually electrically supplied illuminating or lighting means provides a good definition or bounding of the heated area of the heated unit. However, they are positioned outside the actual heating system, so that they are still visible when a saucepan or pot is in place. There is no need for complicated reflectors or light-conducting means for distributing the light.

The lighting elements could be glow lamps, which are relatively simple and operationally reliable, whilst also functioning with a low power consumption, whilst also not being excessively sensitive to temperature. Several lighting elements can be combined into units, e.g. three or four lamps, said units either being bent in accordance with the curvature of the heating unit or are sufficiently flexible to correspondingly adapt thereto. They can then be fixed by means of fixing devices, e.g. shackle, catch or locking devices hung over the rim of the heating unit, the fixing elements preferably being located on both ends of the units, whilst intermediate supports can be provided, in order to ensure a uniform spacing of the glow lamps from the rim of the heating unit.

Thus, several units can be equidistantly circumferentially fixed, e.g. three units, which can leave spaces between them. However, it is still possible to obtain a closed display which is visible from all sides. The indication or display can indicate the on state of the particular heating zone of the cooking appliance, together with other functions, e.g. as a hot indication (residual heat indication), for indicating a particular power setting, etc. In order to bring about variations individual lighting elements of a unit or individual units can be switched on or off. It is also possible to use differently coloured lighting elements or to modify the luminosity of each individual lighting element.

BRIEF DESCRIPTION OF THE DRAWINGS

These and other features of preferred developments of the invention can be gathered from the claims, description and drawings and individual features can be realized individually or in the form of subcombinations in an embodiment of the invention and in other fields and can represent advantageous, independently protectable constructions for which protection is hereby claimed. The invention is described in greater detail hereinafter relative to non-limitative embodiments and the attached drawings, wherein:

DETAILED DESCRIPTION OF THE PREFERRED EMBODIMENTS

Figure 2:
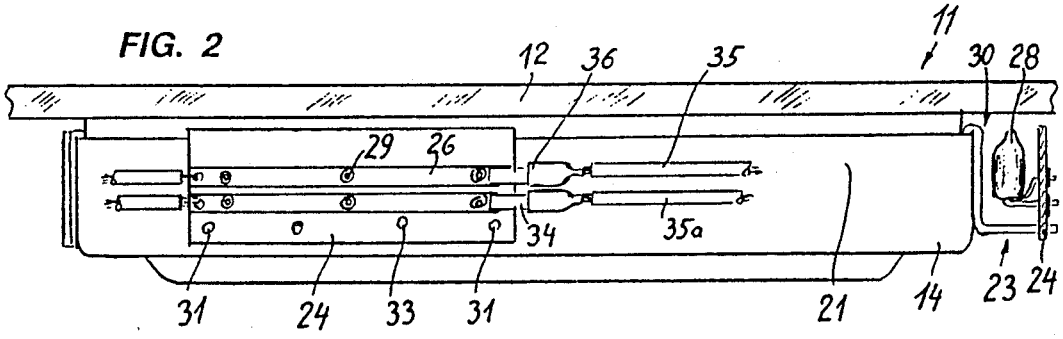
FIG. 2 shows a side view of the radiant heating unit.
Figure 1:
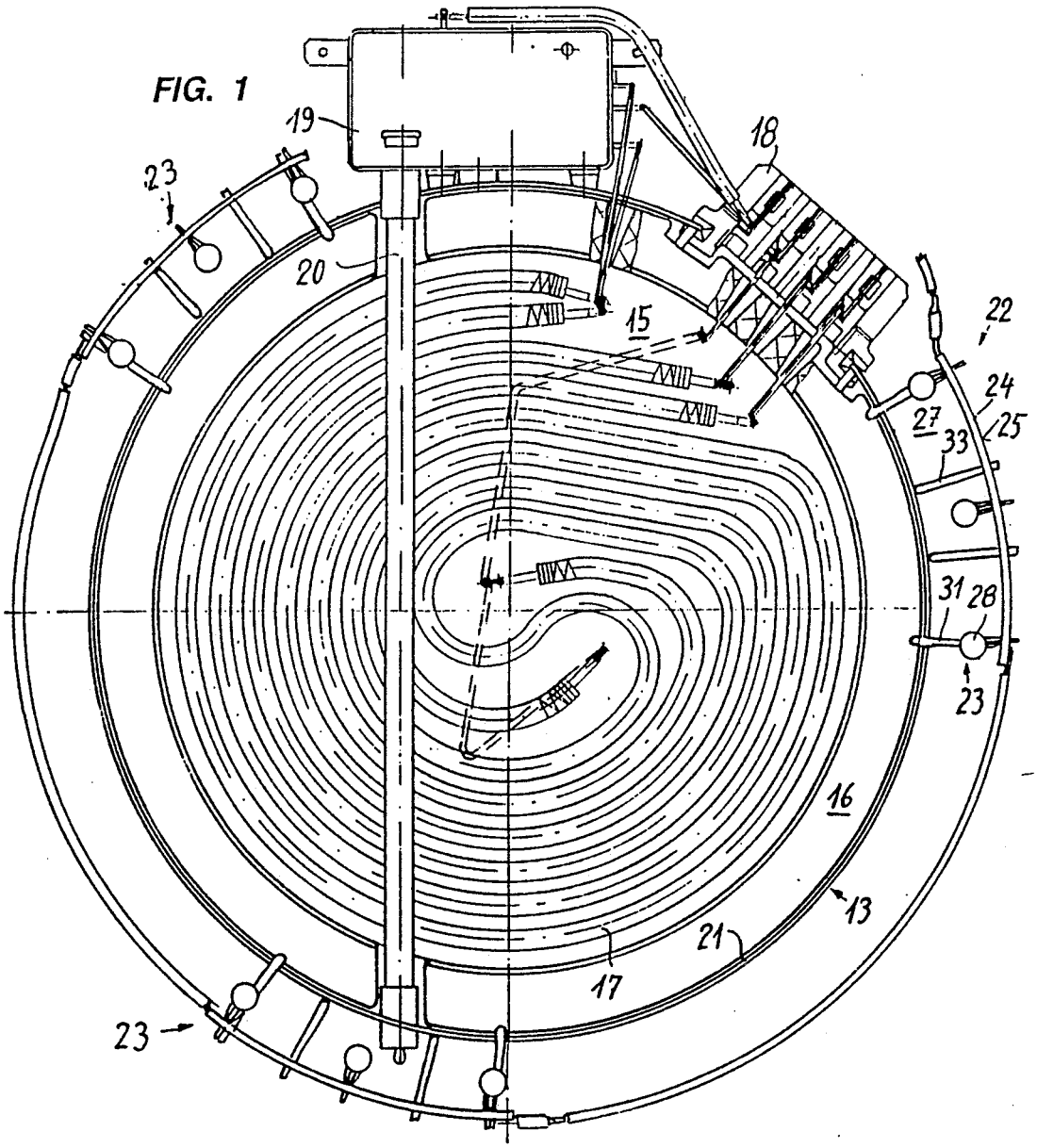
FIG. 1 shows a plan view of a radiant heating unit.
Figure 3:
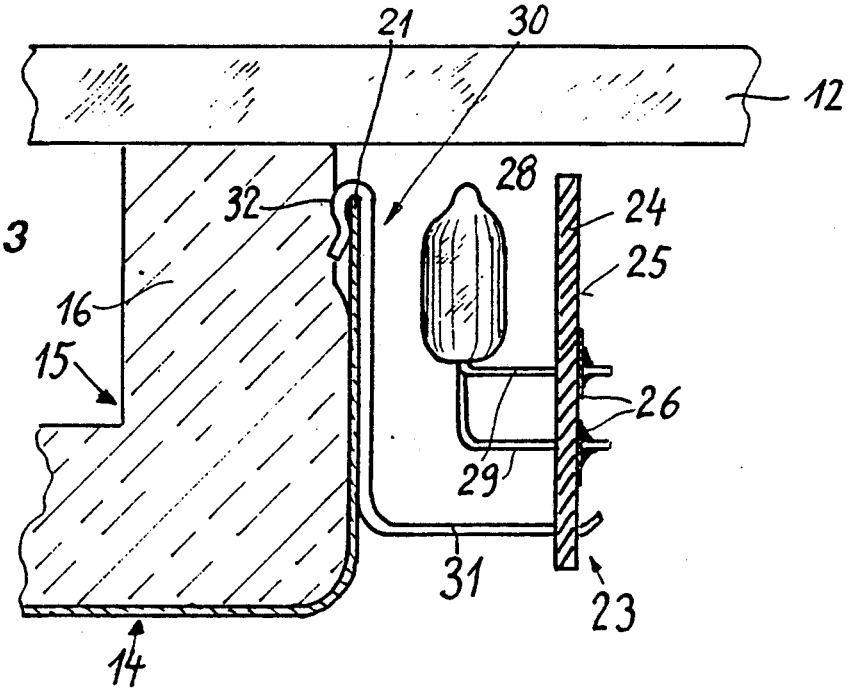
FIG. 3 shows a larger-scale section through the right-hand portion of FIG. 2.

FIGS. 1 to 3 show the part of a cooking appliance 11 having as the cooking surface a glass ceramic plate 12, onto whose underside are pressed several radiant heating units 13, whereof only one is shown. It is located on a sheet metal dish or tray 14, in which is located an insulator 15, whose edge 16 engages on the glass ceramic plate. Spaced from the glass ceramic plate within the tray-shaped insulator is provided a heating means 17 in the form of a heater coil, which is located in the form of a multiple spiral and comprises several individually switchable heating resistors. Connection takes place by means of a connecting piece 18 fixed to the edge of the sheet metal tray. The rod-like sensor 20 of a temperature limiter 19 projects over the heated surface and contains at least one disconnecting contact for at least part of the heating and a signal contact for hot indication. Whilst the temperature limiter responds at the maximum permitted temperature for the glass ceramic plate, the hot indication contact switches at temperatures below 100° C. in order to warn a user of any residual heat of the plate.

Lighting or illuminating means 22 are provided on the outer rim 21 of the sheet metal tray 14 in an area adjacent to and partly surrounding the heating unit. They comprise individual units 23, which only cover a relatively small circumferential area and are uniformly equidistantly spaced, e.g. three units with an in each case 120° displacement. Between them is provided a circumferential spacing, which is usually larger than the circumferential area taken up by the unit.

The represented three units are in each case identically constructed and contain a flexible circuit board 24 made from an insulating material and on whose outside 25 are provided tracks 26, e.g. in the form of a printed circuit. In known assembly technology glow lamps 28 are fixed thereto and are located in the illuminated ring portion area 27 between the rim 21 and the circuit board 24. Their connecting wires 29 project through holes in the circuit board 24 and are soldered to the tracks on the outside 25. In the present embodiment there are three lighting elements, i.e. glow lamps 28 per unit.

Connecting means 30 are fitted to the circuit boards 24 and allow a fixing of said board at a uniform spacing from the outer rim 21. For this purpose a holder 31 is fitted to each end of the circuit board and is formed from a bent wire or sheet metal element, which has a locking portion 32, which is hung in the form of a hook over the upper edge of the outer rim 21 and is automatically prevented from lifting there by the glass ceramic plate. However, any other type of catch or locking connection is also possible. The holder 31 is supported by a portion running parallel to the outer rim 21 on the latter and traverses the ring portion area 27 below the glow lamp, projects through a hole in the circuit board 24 and is connected thereto by a bending or solder connection, but without being connected to a track.

Between the two holders on the rim it is possible to provide support elements 33, which are constructed in accordance with the holder 31, but need not have locking portions 32. They ensure a uniform spacing and therefore a parallel arrangement of the circuit board with respect to the outer rim 21.

It is also possible to have on the circuit board electrical components, e.g. series resistors belonging to the glow lamps. Through material selection and the design of the tracks, said resistors could also be constructed as film resistors.

FIGS. 1 and 2 show that at least at one end of each unit are located attachment plugs 34, e.g. flat-cable plugs, by means of which the three units can be electrically interconnected. For this purpose each conductor 35 can be fixed to one side of the unit, whilst its free end has a quick-connect receptacle 36.

Figure 4:
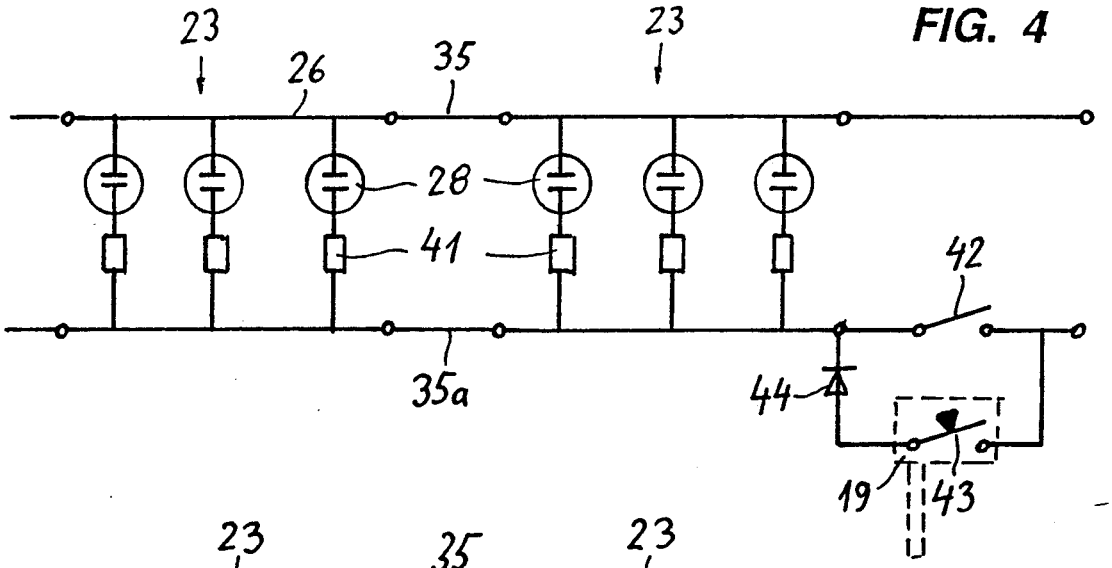
FIGS. 4 & 5 show circuit diagrams for the lighting means.

The connection can take place in accordance with FIG. 4, where the circuit of the heating means for the heating unit is not shown and instead it is only possible to see the circuit for the lighting means 22. The units 23 are so successively connected, that all the lighting elements 28 (glow lamps) with their associated series resistor 41 are connected to the mains voltage parallel to one another between two line strands 35, 35*a*, if the signal contact 42 is closed. The latter belongs to a power switch or control unit for the heating unit and is closed if the appliance is switched on.

The hot indication contact 43 of the temperature limiter 19 is switched so as to bridge the signal contact 42, but this takes place by means of a diode 44, which consequently only allows a half-wave of the mains voltage to act and reduces the power of the lighting means 28. Thus, if there is still residual heat when the heating means 17 is switched off, i.e. the signal contact 42 is open and which could endanger the user or articles placed thereon, the glow lamps 28 still light up, but with reduced power.

Figure 5:
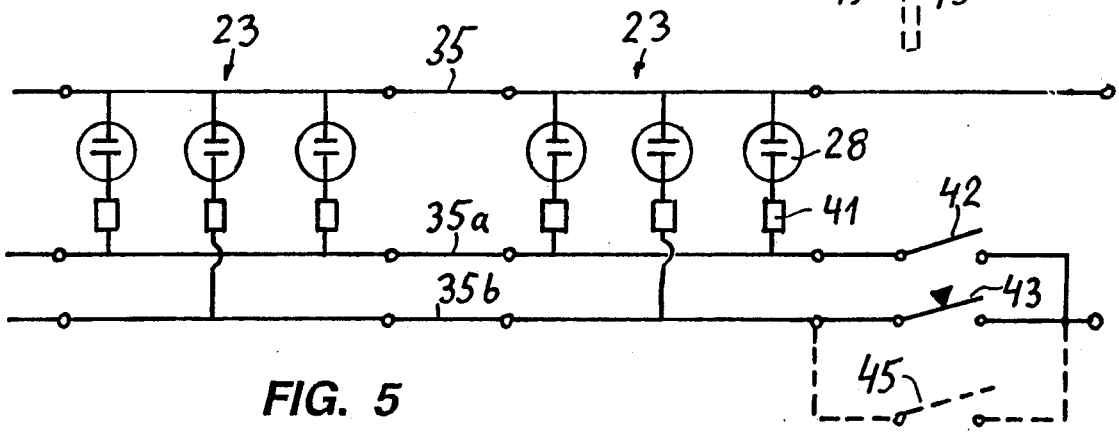

FIG. 5 shows a circuit in which the three line strands 35, 35*a*, 35*b* lead to the units and in each case two lighting elements 28 of each unit are located at the strand 35*a* and the central one is located at the strand 35*b*. The signal contact 42 is here on strand 35*a*, so that with the heating means switched on in each case two glow lamps per unit light up, whereas when the hot indication contact 43 is closed in each case the third lamp is connected in. Thus, during operation an additional monitoring of the hot state is possible, i.e. even when the heating means is switched on the user sees if a particular temperature has been reached. In broken line form is indicated a further general signal contact 45, which is connected parallel to the hot indication contact 43. It makes it possible to switch in the lamps switched by the line strand 35*b* immediately when the hot point is switched on and for this purpose is operated together with the signal contact 42.

The invention provides a striking, optically interesting indication or display, which is easy to fit, optionally also subsequently and which is constructed in modular manner from simple components. As a result of its well ventilated arrangement on the outer rim it is not harmed by high temperatures. The circuit boards protect the illuminated ring area 17 to the outside, so that optionally even without separate masking of the glass ceramic plate it is possible to work at this point. However, this is preferably assisted by such a masking or a surface decoration. The same applies with respect to hard glass hobs in which are mounted the individual hotplates, e.g. with cast bodies. In this case the illuminated area should only start outside the conventionally provided mounting ring, where th thermal stressing is also lower. Optionally the lighting means could be fitted to a shielding and centring ring, which is normally positioned between the hotplate and the opening rim when the hotplates are installed in openings in hard glass hobs.

In the case of this circuit the series resistors 41 could also be combined for one or more units and it would be possible to use as lighting elements other lamps, e.g. small incandescent lamps. The modular construction, particularly with flexible circuit boards, makes it possible to use the same units for heating elements of different diameters or types, e.g. also for elongated heating elements. With heating units of different sizes either more or less heating units could be provided or the reciprocal spacings modified, which ensures maximum constructional flexibility. This is also helped by the advantageous connection by a double or triple open ring main, which permits a random attachment of units. The circuit boards could have a L-shaped cross-section covering the bottom of the area 27 and/or could be internally reflecting in order to optically utilize the lighting effect.

We claim:

1. A cooking appliance comprising an at least partly transparent or translucent upper surface, lighting means positioned in an area surrounding a heating unit and indicating an operation state, the operation state being one of a switching control or temperature state of the heating unit, the lighting means containing a row of individual electric lighting elements.

2. The cooking appliance according to claim 1, wherein the lighting elements are individually electrically operated.

3. The cooking appliance according to claim 1, wherein the lighting elements are glow lamps.

4. The cooking appliance according to claim 1, wherein several lighting elements are combined to form lighting units, which are fixed to the outside of the heating unit.

5. The cooking appliance according to claim 1, wherein several lighting units are arranged with a uniform angular spacing from one another.

6. The cooking appliance according to claim 1, wherein the lighting units are spaced from the outer rim of the heating unit.

7. The cooking appliance according to claim 4, wherein the lighting units are fixed to the heating unit by connecting means.

8. The cooking appliance according to claim 7, wherein the connecting means cooperate with an upper edge of a rim of the heating unit.

9. The cooking appliance according to any one of the claims 3 to 5, wherein the lighting units at least have a limited flexibility.

10. The cooking appliance according to claim 3, wherein the units contain circuit boards, which contain connecting tracks for the lighting elements and carry the said elements, the tracks being located on the side of the circuit board remote from the heating unit.

11. The cooking appliance according to claim 10, wherein the circuit boards outwardly limit the area illuminated by the lighting elements.

12. The cooking appliance according to claim 10, wherein on the circuit boards are provided fixing spacing and electrical connecting means.

13. The cooking appliance according to claim 10, wherein the lighting elements and further components contain connecting and fitting parts, being passed through holes in the circuit board and being fixed by connection means of a group comprising soldering and positive connection means.

14. The cooking appliance according to claim 4, wherein individual lighting units can be separately switched on.

15. The cooking appliance according to claim 4, wherein at least one individual lighting element per lighting unit can be seperately switched on.

16. The cooking appliance according to claim 1, wherein the luminosity of the lighting elements can be varied.

17. The cooking appliance according to claim 1, wherein the lighting means are constructed for displaying differently the switched on heating means of the heating unit and the hot state of the heating unit.

* * * * *